United States Patent [19]

Ekhoff

[11] Patent Number: 4,736,475

[45] **Date of Patent: * Apr. 12, 1988**

[54] ABRADING MACHINE FOR DISK SHAPED SURFACES

[76] Inventor: Donald L. Ekhoff, 14137 Hidden Spring La., Morgan Hill, Calif. 95037

[ * ] Notice: The portion of the term of this patent subsequent to Jun. 9, 2004 has been disclaimed.

[21] Appl. No.: 7,126

[22] Filed: Jan. 27, 1987

Related U.S. Application Data

[63] Continuation-in-part of Ser. No. 798,589, Nov. 15, 1985, Pat. No. 4,671,018.

[51] Int. Cl.[4] ..... B24B 3/46

[52] U.S. Cl. ..... 51/104; 51/140; 51/145 R; 51/154

[58] Field of Search ..... 51/145 R, 145 T, 140, 51/141, 237 T, 154, 155, 236, 237 M, 135 R, 262 T, 262 A, 104

[56] References Cited

U.S. PATENT DOCUMENTS

| | | | |
|---|---|---|---|
| 4,038,785 | 8/1977 | Scott | 51/145 R |
| 4,347,689 | 9/1982 | Hammond | 51/145 R |
| 4,532,665 | 8/1985 | Evans et al. | 51/104 |
| 4,671,018 | 6/1987 | Ekhoff | 51/145 T |

*Primary Examiner*—Frederick R. Schmidt
*Assistant Examiner*—Maurina Rachuba
*Attorney, Agent, or Firm*—Thomas Schneck

[57] ABSTRACT

A surface finishing apparatus for disks and the like characterized by an eccentric spindle of small diameter engaging the inner circumference of a disk; a drive mechanism engaging the outer circumference of the disk to rotate the disk around an axis parallel to but not coaxial with the spindle; and a finishing mechanism which extends fully between the inner circumference and the outer circumference of the disk. Because the diameter of the spindle is less than the diameter of the center aperture formed by the inner circumference of the disk, a gap is formed. The finishing mechanism has a first edge disposed within the gap and has a second edge beyond the outer circumference of the disk. Thus, a full surface finish is provided by a stationary finishing mechanism. The finishing mechanism traverses a segment of the disk that is parallel to a radius of the disk. A transport mechanism is provided to move an unfinished disk to a finishing station for processing, and to remove a finished disk from the finishing station. The finishing mechanism includes an elongated, abrasive tape which can be looped against itself to remove large particles prior to its contact with the disk.

19 Claims, 5 Drawing Sheets

ABRADING MACHINE FOR DISK SHAPED SURFACES

DESCRIPTION

Cross Reference to Related Application

This application is a continuation-in-part of application Ser. No. 798,589 to Ekhoff, filed Nov. 15, 1985, now U.S. Pat. No. 4,671,018.

TECHNICAL FIELD

This invention relates generally to abrasive surface finishing machines, and more particularly to apparatus for polishing rigid disk and similar surfaces by abrading.

BACKGROUND ART

Winchester disk drives include a flat, annular, rigid disk coated with a magnetic material, and a magnetic head assembly which encodes and decodes digital information in the magnetic material of the disk. The disk and head assembly are enclosed within an air-tight enclosure, and the disk is rotated rapidly around its axis by an electric motor. The head assembly moves radially across the surface of the disk between various recording tracks in the magnetic material.

The trend in the industry is to pack ever greater amounts of data onto a single rigid disk, which implies increasing the bit density on the disks. A disk's bit density is inversely proportional to the size of the magnetic domains that stores an individual bit. In other words, as the magnetic domains decrease in size, the bit density of the disk increases. To decrease the size of a magnetic domain the magnetic layer should be as thin as possible, and the distance between the head assembly and the magnetic material should be minimized.

As the separation between the head and the disk decreases, the chance of a disk head "crash" increases. In a head crash, the head assembly scrapes the surface of the magnetic layer, destroying the data stored on the disk. To minimize the chance of a head crash, the environment within the Winchester enclosure is made as free as possible of particulate matter, and the magnetic layer is made as smooth as possible.

A necessary prerequisite to a smooth magnetic surface is a smooth, polished surface on an uncoated rigid disk. While a number of materials, including plastic, have been used as base materials for a rigid disk, virtually all rigid disks in present day use are made from aluminum. Thus, the problem faced by the industry was to develop rigid disk finishing machinery capable of producing a smooth finish on an aluminum disk.

The rigid disk finishing machines of the prior art typically include a spindle which clamps to the inner circumference of a rigid disk, a motor for rotating the disk, and an abrasive member which oscillates radially back and forth across the surface of a disk. Typically, these machines process only a single disk at a time. U.S. Pat. No. 4,347,689 to Hammond discloses such an apparatus.

The disk finishers of the prior art have several noticeable disadvantages. Firstly, since the spindle is clamped to the disk the surface of the disk surrounding the inner circumference is sometimes damaged. Secondly, and again due to the clamping of the spindle to the disk, the disk cannot be polished fully from its outside circumference to its inside circumference. This, of course, reduces the useful surface area of the disk. Finally, the oscillation of the abrasive member radially across the rotating dish can produce small, overlapping spiral grooves in the surface of the disk, which can affect the ultimate performance of the disk drive unit. In a prior application, an apparatus was disclosed which is closely related to the present invention and which eliminates these problems. That apparatus, however, produced grooves which were concentric with the rigid disk when brought into contact with an abrasive strip having an oversized abrasive particle. Production of concentric grooves is detrimental in applications having a slowly moving abrasive strip or a high revolution disk.

Some rigid disk finishing machines utilize an abrasive strip which is moved across the surface of the disk. A problem with abrasive strips is that an occasional large, abrasive particle embedded in the surface of the strip can damage or ruin a disk.

An object of the present invention is to provide a surface finishing apparatus for disks and the like capable of abrasively finishing an annular surface fully and simultaneously from its inner radius to its outer circumference. Another object is to provide such an apparatus which minimizes abrasive damage to a disk or the like during the finishing operation.

DISCLOSURE OF THE INVENTION

The above objects have been met by a disk finishing apparatus having a non-oscillating, full surface abrasive strip which, by means of an offset position, non-symmetrically distributes abrasive damage zones to the extent that they cannot be observed.

Briefly, the invention comprises a cylindrical eccentric spindle having a diameter smaller than the internal diameter of the rigid disk, a finishing strip, and a pair of drive sheaves which contact the outer circumference of the rigid disk. The sheaves are caused to rotate which rotates a disk about an axis that is parallel to and spaced apart from the axis of the cylindrical spindle. A finishing strip having a width greater than the distance between the inner circumference and the outer circumference of the rigid disk is urged against a nonradial section of the disk as both the finishing strip and the disk are set in motion.

Since the eccentric spindle is smaller circumference than the inner circumference of the rigid disk, a gap is formed between the spindle and a portion of the disk's inner circumference. With one edge of the finishing strip within this gap and an opposed edge beyond the outer circumference of the disk, the finishing strip is able to provide a truly full surface finish.

The movement of the finishing strip contacting a nonradial segment of the rigid disk ensures that any oversized abrasive particle will not contact any point on the rigid disk a second time. Optimally, the speed of the finishing strip and the rotation of the rigid disk are such that an oversized particle will form contiguous spiral grooves, distributed over the disk so that damage cannot be observed.

The finishing strip is caused to loop back against itself to dress the abrasive surface prior to contact with the rigid disk. By dressing the abrasive strip large particles of abrasive can be removed, minimizing the chance of damaging the disk. Additionally, various adjustments are provided to ensure that the finishing strip provides a substantially uniform force across the nonradial segment of the disk.

An advantage of the present invention is that a surface can be finished or cleaned across its entirety, without damage caused by the clamping spindles of the prior art.

Yet another advantage of this invention is that surfaces may be finished more quickly than was possible with devices of similar function in the prior art.

BEST MODE FOR CARRYING OUT THE INVENTION

Figure 2:
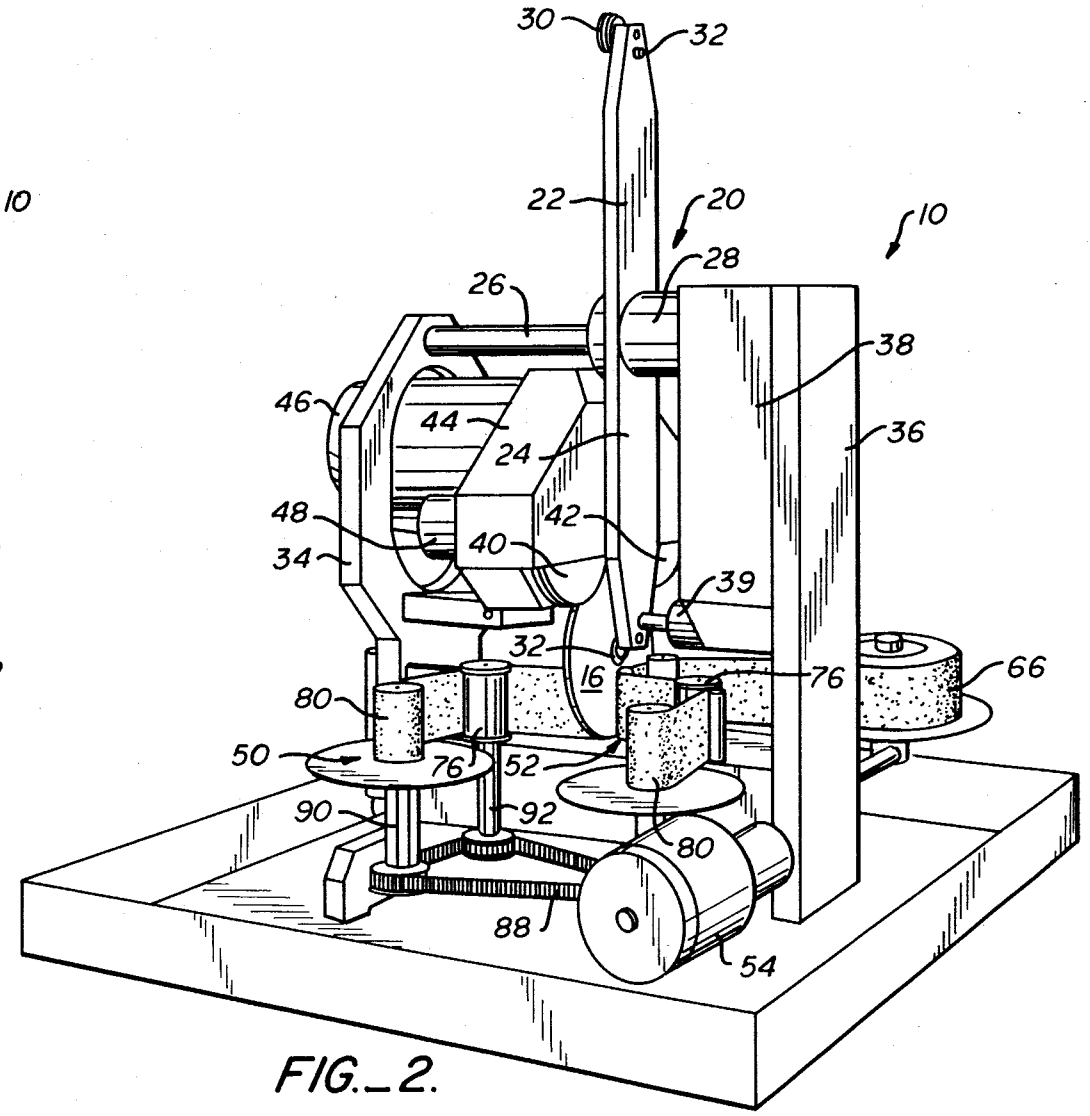
FIG. 2 is a rear perspective view of the apparatus of FIG. 1.
Figure 1:
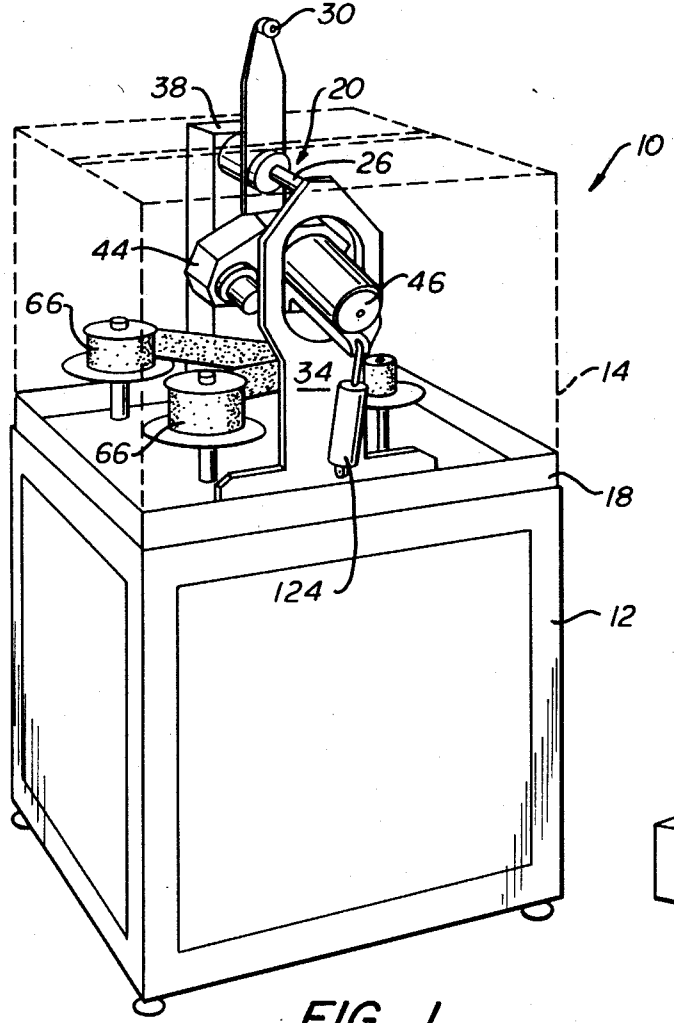
FIG. 1 is a frontal perspective view of a rigid disk finishing apparatus in accord with the present invention.

With reference to FIGS. 1 and 2, a hard disk finishing apparatus 10 includes a frame 12 which supports the remainder of the apparatus above ground level. The frame is preferably made of a light weight, strong material such as tubular steel. The finishing apparatus 10 is typically twenty-five inches wide, twenty-two inches deep, and fifty inches high. A removable glass cover 14 (shown in phantom) is included to protect the rigid disk 16 to be finished. The glass cover 14 fits within a wet pan 18.

A transport device 20 having two arms 22 and 24 is attached to a shaft 26 that may be rotated by a motor 28. Each of the arms 22 and 24 is provided with an eccentric spindle 30 and a lubrication stud 32. The annular rigid disk 16 is supported by its inner circumference by one of the eccentric spindles 30. The transport device 18 is fixed between a front support plate 34 and a back support plate 36 having a housing 38.

An arm locking mechanism 39 selectively locks the transport device 20 into position. When the arm locking mechanism is moved away from the lubrication stud 32, motor 28 rotates arms 22 and 24 so that a finished disk 16 is moved outside of the glass cover 14 and an unfinished disk is set into finishing position. FIG. 1 illustrates the apparatus 10 in a disengaged position without a rigid disk. FIG. 2 illustrates the apparatus 10 is an engaged position having a rigid disk 16 in a finishing position.

As will be explained in more detail below, the rigid disk 16 is rotated by a pair of disk drive sheaves 40 and 42. The drive sheaves are supported for rotation by a sheave frame 44 and are powered by a motor assembly 46. A drive belt (not shown) transfers rotational power from the motor assembly 46 to the disk drive sheaves 40 and 42 so as to rotate the drive sheaves about spindles 48.

The rigid disk 16 is finished by a front strip assembly 50 which applies force to a first side of the disk 16 and by a back strip assembly 52 which simultaneously applies force to a second side of the disk. The strip assemblies 50 and 52 are driven by an electric motor 54.

Figure 3:
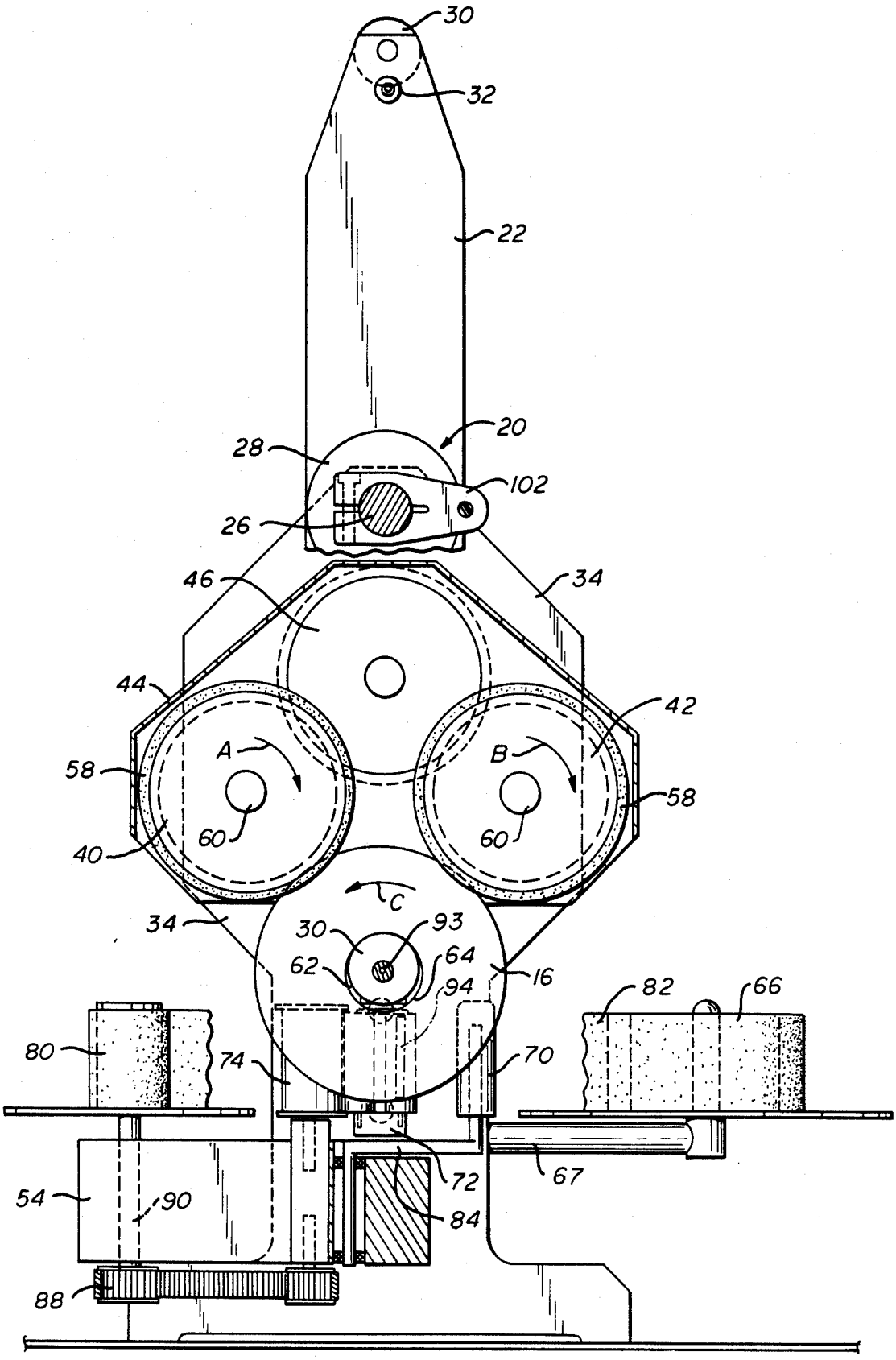
FIG. 3 is a part sectional rear view of the apparatus of FIG. 2.

Now referring to FIG. 3, sheave motor assembly 46 provides power to rotate the disk drive sheaves 40 and 42 in the direction of Arrows A and B. Each of the drive sheaves 40 and 42 has a V-shaped groove cut into the circumference to contact the outer circumference 56 of a rigid disk 16. Preferably, an outer circumferential portion 58 of the drive sheaves is made from a flexible, plastic material to increase friction between the drive sheaves and the rigid disk 16. By simultaneously rotating drive sheaves 40 and 42 about axes 60, the rigid disk 16 is caused to rotate in an opposing direction, as shown by Arrow C.

Figure 4:
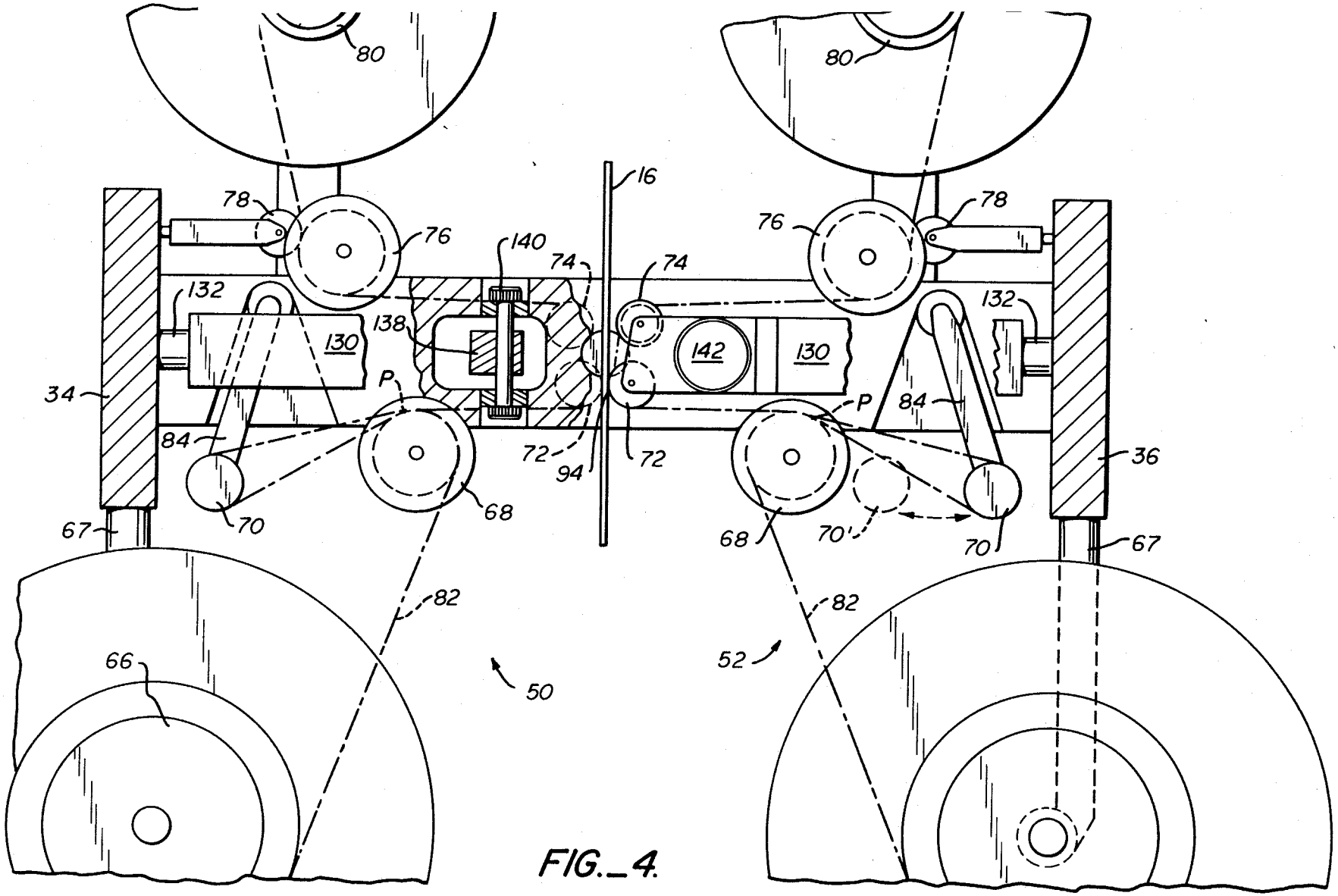
FIG. 4 is a top view of the abrasive tape roll system of FIG. 2.

Critical to proper operation of the apparatus is the gap 62 between the eccentric spindle 30 and the inner circumference 64 of the rigid disk 16. Referring specifically to FIG. 3 and 4, with a persepective view provided by FIG. 2, the front and the back strip assemblies 50 and 52 may be seen. Each strip assembly 50 and 52 includes a source reel 66, and idler roller 68, a tensioning roller 70, a contact roller 72, a flanged roller 74, a capstan 76, a pinch roller 78 and a take-up reel 80.

Source reels 66 are secured to support plates 34 and 36 by arms 67 and include a supply of abrasive finishing tape 82 which is a long strip of flexible material. Tape 82 is trained around rollers 68–76 in succession, then engaged with take-up reel 80.

The finishing tape 82 is provided with abrasive on the surface which ultimately contacts the rigid disk 16. A problem encountered in the prior art is that large particles of abrasion occasionally have been brought into contact with the surface of the disk 16. Oversized particles will damage the disk. To reduce this problem, the finishing tape 82 is looped back on itself by the tensioning roller 70 such that the tape 82 rubs against itself at a point P on the idler roller 68. Thus the finishing tape "dresses" itself to remove large particulate matter from the tape 82 prior to its application to the rigid disk 16.

Tensioning rollers 70 are supported by L-shaped arms 84 having an extension 86 that is hinged to support plates 34 and 36. A spring (not shown) biases the L-shaped arm 84 away from the disk 16 to provide tension to the loop of finishing tape 82 engaged with the tensioning roller 70. When no tape is present the tensioning roller moves to a position 70. Motor 54 supplies rotational drive to the capstans 76 and the take-up reels 80 by means of drive belt 88 and shafts 90 and 92.

The rigid disk 16 is supported on the cylindrical eccentric spindle 30. It can be seen in FIG. 3 that the inner circumference 64 of the rigid disk is larger than the circumference of the spindle 30. Thus, a gap 62 is formed. The gap 62 allows the finishing strips 82 to contact a segment 94 of the rigid disk surface that extends fully from the inner circumference 64 to the outer circumference 56 of the rigid disk. By placing the upper edge of the finishing tape 82 within the gap 62 and the lower edge of the finishing tape beyond the outer circumference 56 of the rigid disk, the apparatus is able to provide a full surface finish to the disk and, in doing so, eliminates the problems associated with roller and tape edges contacting the surface of a disk. The spindle 30 freely rotates about a spindle axis 93. The disk rotates about a disk axis that is spaced apart from the spindle axis 93 by the amount of the gap 62.

FIGS. 3 and 4 illustrate that the segment 94 of the rigid disk which is contacted by the abrasive tape 82 is offset from the radius of the rigid disk 16. That is, the tape makes nonradial contact with the rigid disk.

This nonradial contact is important to many applications and critical in certain applications. The drive sheave motor 46 is constructed to cause the rigid disk 16 to selectively rotate anywhere between 100 and 1,800 revolutions per minute. In high revolution applications an oversized abrasive particle would cut a deep groove into the surface of the rigid disk if the contact with tape 82 were radial, rather than the nonradial contact of the present invention. The nonradial contact, however, will prevent a particle from cutting a deep groove. Because the abrasive tape 82 is moving from the source reel 66 to the take-up reel 80, the mark of an oversized particle will be distributed as the rigid disk rotates. Spiral grooves may be cut into the surface but because the finishing tape 82 is not oscillated the spiral grooves will not overlap one another and damage is not apparent.

Rigid disk stability is provided by a three-point contact comprising the contact with the separate drive sheaves and abrasive tape contact with the disk at segment 94. FIG. 4 shows the two contact rollers 72 being on direct opposite sides of the rigid disk 16. Optimally, one of the contact rollers 72 may be interchanged with the associated flange roller 74 so that the segments 94 of contact will be on opposite sides of the spindle, as viewed in FIG. 4, as well as being on opposite sides of the rigid disk.

Figure 5:
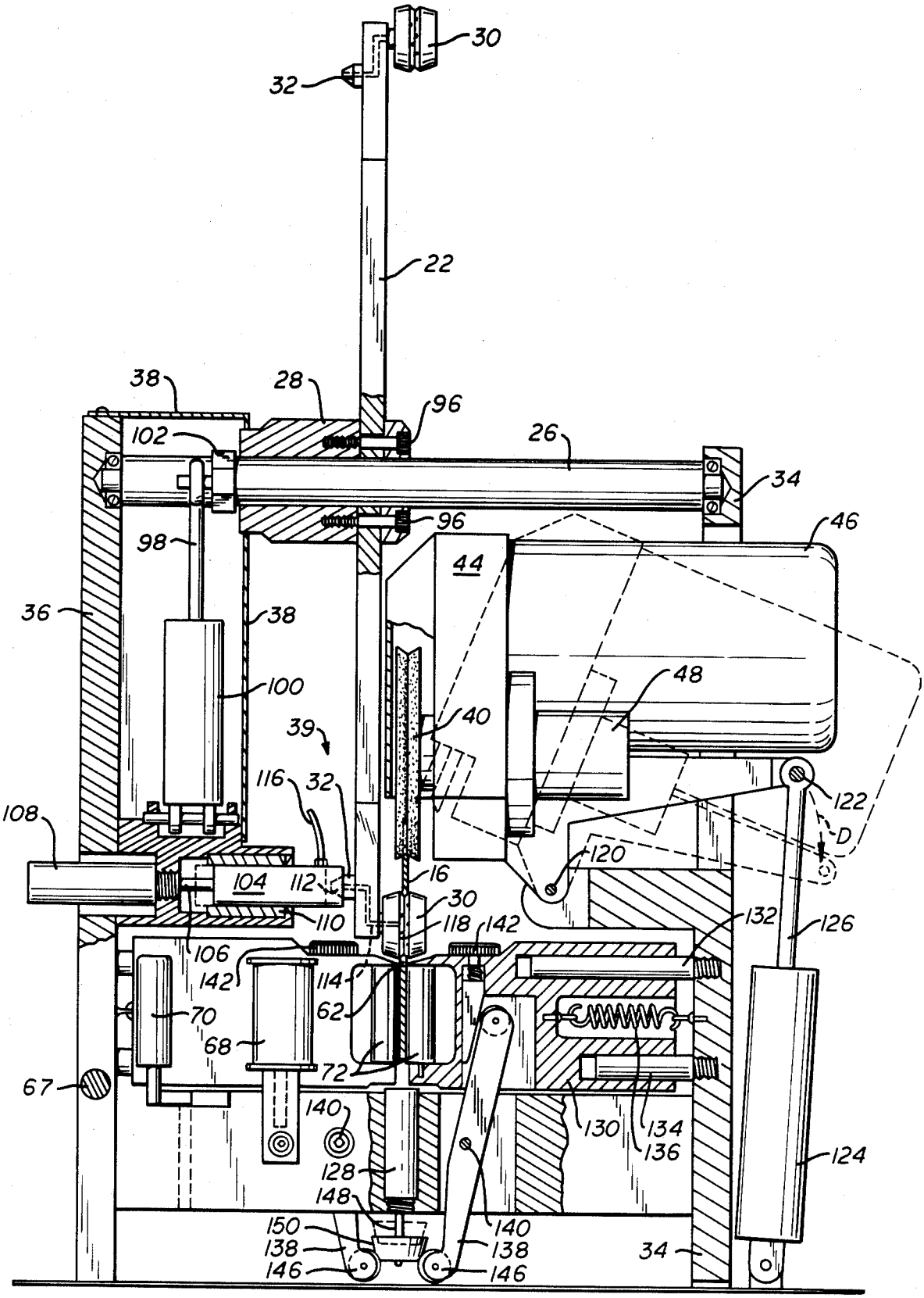
FIG. 5 is a side view of apparatus of FIG. 1, partly in section.

In operation, FIG. 5 illustrates the apparatus in an engaged condition and FIG. 5 illustrates the apparatus in a disengaged condition. Referring first to FIG. 5, a rigid disk 16 is fitted about an eccentric spindle 30. The spindle is then brought into a finishing position by rotation of the arms 22 and 24. Motor 28 provides the means of rotation. The motor 28 rotates the shaft 26 which, in turn, rotates arms 22 and 24. The motor assembly is held together by bolts 96. When the shaft 26 is moved about its axis by motor 28, a rod 98 from cylinder 100 is pushed into the cylinder 100 and then pulled back out as the end of the rod 98 moves to the opposite side of the shaft 26. The rod is held to the shaft 26 by a brace 102. Brace 102 may be seen best in FIG. 3. the opposite action occurs when the position of arm 24 is to be taken by arm 22.

An arm locking mechanism 39 includes a cylinder 104 and a shaft 106 which can be extended from or retracted into a pneumatic cylindner 108. The cylinder 104 is slidably mounted in housing 110. The ends of cylinder 104 is provided with a conical recess 112 which is adapted to engage the truncated, conical end of the lubrication stud 32. When the end of cylinder 104 is engaged with the lubrication stud 32, the arm 24 is locked into position.

Conical recess 112 is coupled by a passage 114 to a lubrication hose 116. The lubrication hose 116 is coupled to a lubrication reservoir by a hydraulic pump (not shown). When activated, lubrication flows under pressure through hose 116, into the passage 114 and ont the disk 16 by means of holes in the V-shaped groove 118 of the eccentric spindle 30. Due to the gap 62 between the spindle 30 and the inner circumference of the rigid disk, the lubrication is able to flow freely onto the surface of the disk.

Figure 5A:
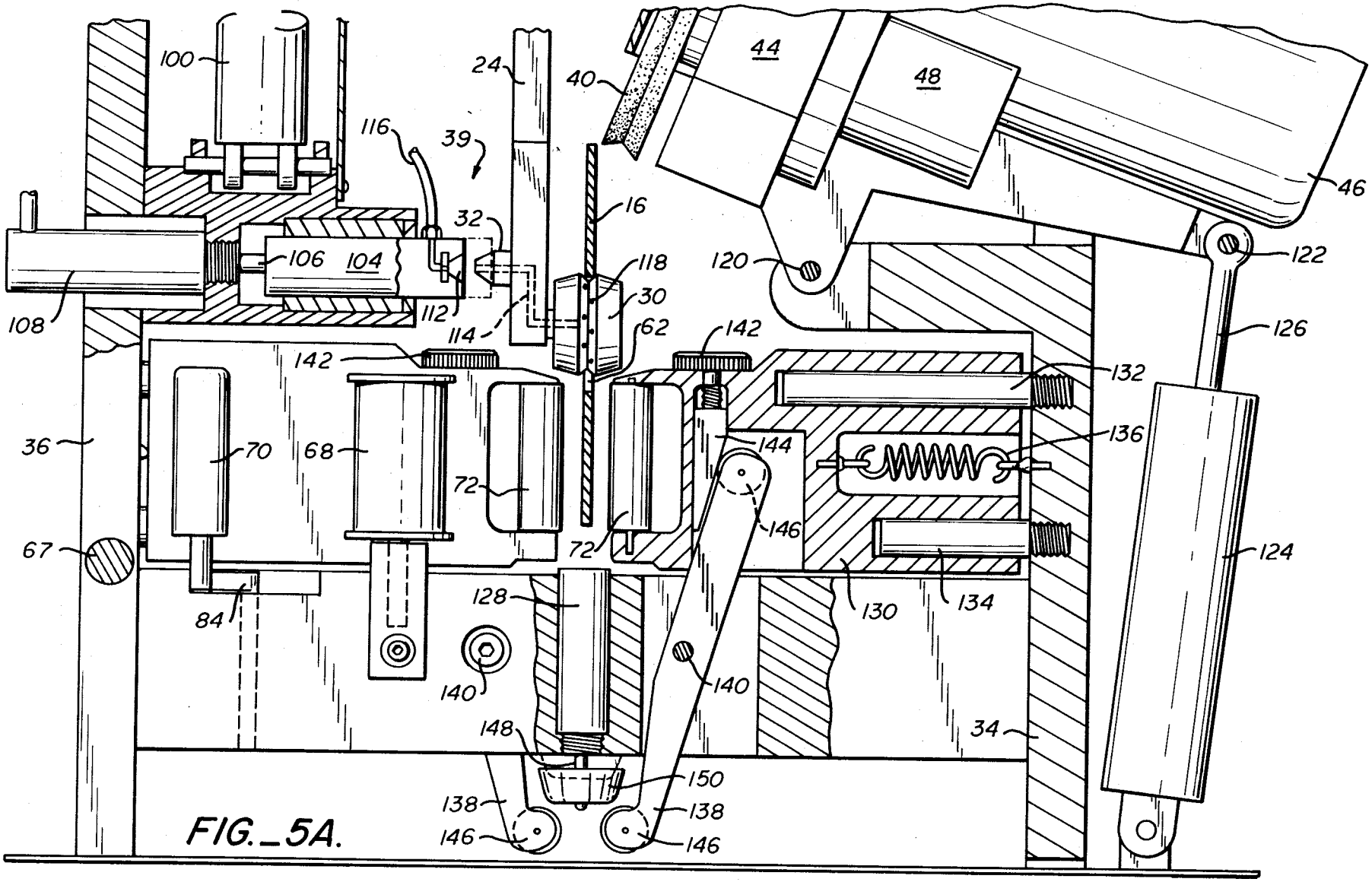
FIG. 5*a* is a side view of the apparatus of FIG. 5 in a disengaged position.

The motor assembly 46 and the drive sheaves 40 and 42 is supported by pivot assemblies 120 and 122 such that there is motion as indicated by Arrow D. In the position shown in FIG. 5, the V-shaped grooves of the drive sheaves 40 and 42 are brought into contact with the rigid disk 16. A pneumatic cylinder 124 is coupled between the support plate 34 and the pivot 122. More specifically, a cylinder 124 is attached to a shaft 126 which connects to the pivot 122 so that when the pneumatic cylinder 124 is activated the shaft 126 will be extended from or retracted into the cylinder. FIG. 5 shows the shaft 126 in an extended position, thereby bringing the drive sheaves 40 and 42 into an engaged condition. FIG. 5*a* illustrates the shaft 126 in a retracted position, clearing the drive sheave 40 to allow removal of the rigid disk 16 by rotation of arm 24. FIG. 5*a* also illustrates the arm locking mechanism 39 in a position to permit rotation of the arm 24.

Referring again to FIG. 5, yet another pneumatic cylinder 128 activates the contact rollers 72. A carriage 130 is slidably coupled to a pair of rails 132 and 134. The rails each have an end fastened to the support plate 34. The carriage 130 is urged in the direction of the support plate 34 by a spring 136. However, the carriage may be forced in the direction of the disk 16 by power arm 138. The power arm 138 is pivotable at pivot point 140. The force that power arm 138 places upon the contact roller 72 may be fine-tuned at knob 142. Knob 142 includes a bolt which adjusts the positioning of a shim 144.

The opposed ends of the power arms 138 contain rollers 146. A shaft 148 extends into the spring return pneumatic cylinder 128. The shaft 148 is attached to a conical cam 150. When the pneumatic cylinder 128 is activated, as shown in FIG. 5, the power arm 138 forces the contact roller 72 against the rigid disk 16. On the other hand, when the cylinder 128 is deactivated, the conical cam 150 is moved away from the power arm rollers 146, thereby permitting spring 136 to pull the contact roller 72 away from the rigid disk 16, as shown in FIG. 5*a*.

While the invention has been described with reference to magnetic disks, the surface finishing apparatus of this invention is applicable to optical surfaces, such as lenses, mirrors and the like.

I claim:

1. A surface finishing apparatus for disks and the like comprising, a freely rotating spindle having a cylindrical configuration rotatable about a spindle axis, an annular disk having an inner circumference defining a center aperture, said inner circumference fitted about the circumference of said cylindrical spindle, said center aperture having a diameter greater than the diameter of said spindle, said disk having opposed first and second surfaces and having an outer circumference, sheave drive means contacting said outer circumference of said disk to form a gap between said disk and a portion of said cylindrical spindle means opposite said sheave drive means when said inner circumference of said disk is supported by said spindle means, said sheave drive means being operative to rotate said disk around a disk axis which is parallel to said spindle axis, said disk axis and said spindle axis spaced apart by a distance equal to said gap; and a first side finishing means selectively engaging a segment of said first surface of the disk fully between said gap and said outer circumference, said segment extending parallel a radius of said disk, said first side finishing means providing a substantially uniform force across said segment.

2. The apparatus of claim 1 wherein said first side finishing means includes a strip of flexible material having a width greater than the distance between said outer circumference and said inner circumference of the disk, said strip of flexible material having a first side disposed within said gap between said disk and said portion of the spindle means, said apparatus further comprising a means for drawing said strip past said disk.

3. The apparatus of claim 2 further comprising means for looping said strip about itself prior to contacting said disk.

4. The apparatus of claim 2 further comprising means for selectively pressing a section of said strip against said first surface of said disk.

5. The apparatus of claim 1 wherein said drive means includes a drive sheave contacting said outer circumference of said disk.

6. The apparatus of claim 5 wherein said drive sheave is a first drive sheave, said sheave drive means comprising a second drive sheave contacting said outer circumference of said disk, wherein the axes of rotation of said first drive sheave, said second drive sheave, and said disk are parallel.

7. The apparatus of claim 6 further comprising drive motor means coupled to said first drive sheave and said second drive sheave, said first drive sheave and said second drive sheave having substantially identical angular velocity.

8. The apparatus of claim 6 further comprising means for moving said first drive sheave and said second drive sheave towards and away from said spindle means.

9. The apparatus of claim 1 further comprising second side finishing means adapted to engage said second surface of said disk said second side finishing means extending from said outer circumference of said disk to said inner circumference of said disk.

10. A surface finishing apparatus for disks and the like comprising, a cylindrical eccentric spindle having a spindle axis, an annular disk having an inner circumference and an outer circumference, said inner circumference defining a center aperture, said cylindrical eccentric spindle disposed within said center aperture and having a diameter less than the diameter of said center aperture, said disk having opposing first and second surfaces, drive means having a pair of sheaves, each sheave including a sheave circumference having a V-shaped groove contacting said outer circumference of the disk to form a gap between said spindle and a portion of said inner circumference of the disk, said drive means powering said pair of sheaves to rotate said disk about a disk axis spaced apart from said spindle axis by a distance equal to said gap, an elongated, flexible strip member having a first side and a second side, said strip member having a finishing material applied to said first side and having opposed first and second edges, said first edge disposed within said gap and spaced apart from said second edge by a distance greater than the distance between the circumference of the spindle and the outer circumference of the disk, said strip member traversing a segment of the disk parallel to a radius of said disk, and means for drawing said strip member past said segment of the disk, said strip member providing a substantially uniform force across said segment.

11. The apparatus of claim 10 further comprising means for looping said strip member about itself such that a first portion of said first side is caused to rub against a second portion of said first side prior to contacting said segment of the disk.

12. The apparatus of claim 10 further comprising a second elongated, flexible strip member traversing a segment of said second surface of the disk, said second elongated flexible strip having a first edge disposed within said gap.

13. The apparatus of claim 10 wherein said spindle has a lubrication channel which can be coupled to a source of lubrication, said lubrication channel having an outlet orifice adapted to spray lubrication on said disk from a position within said inner diameter of said disk.

14. A surface finishing apparatus for disks and the like comprising, a flat, annular, disk having an inner circumference defining a center aperture, and outer circumference and opposing first and second sides, eccentric, cylindrical spindle means having a spindle axis, said spindle means being freely rotatable about said spindle axis and having a maximum perpendicular dimension relative to said spindle axis which is less than the diameter of said center aperture of the disk, said spindle means having a lubrication channel selectively coupled to a source of lubrication, said lubrication channel having an outlet orifice adapted to spray lubrication on said disk from a position within said inner circumference of said disk, drive means contacting said outer circumference of said disk when said inner circumference is supported by said spindle means, said drive means being operative to rotate said disk around a disk axis which is parallel to and spaced apart from said spindle axis, first side finishing means selectively engaging a segment of said first side of said disk, said first side finishing means extending from said outer circumference of said disk to said inner circumference of said disk, said segment displaced from a radius of said annular disk, and means for drawing said first side finishing means past said segment of the disk, said first side finishing means providing a substantially uniform force across said segment.

15. The apparatus of claim 14 wherein said drive means includes a drive sheave contacting said outer circumference of said disk.

16. The apparatus of claim 15 wherein said drive sheave is a first drive sheave, and further comprising a second drive sheave contacting said outer circumference of said disk, wherein the axes of rotation of said first drive sheave, said second drive sheave, and said disk are parallel.

17. The apparatus of claim 14 wherein said first side finishing means includes a strip of flexible material having a width greater than the difference between said outer diameter and said inner diameter of said disk.

18. The apparatus of claim 17 further comprising means for looping said strip about itself prior to contacting said disk.

19. The apparatus of claim 14 further comprising second side finishing means adapted to engage said second side of said disk, said second side finishing means extending from said outer circumference of said disk to said inner circumference of said disk.

* * * * *